US006830100B2

(12) United States Patent
Gowan et al.

(10) Patent No.: US 6,830,100 B2
(45) Date of Patent: Dec. 14, 2004

(54) EXTRUDED MANIFOLD

(75) Inventors: James D. Gowan, Montgomery, AL (US); Norman F. Costello, Mt. Pleasant, SC (US)

(73) Assignee: Thermalex, Inc., Montgomery, AL (US)

( * ) Notice: Subject to any disclaimer, the term of this patent is extended or adjusted under 35 U.S.C. 154(b) by 0 days.

(21) Appl. No.: 09/985,337

(22) Filed: Nov. 2, 2001

(65) Prior Publication Data

US 2003/0085030 A1 May 8, 2003

(51) Int. Cl.[7] ..... F28F 9/04
(52) U.S. Cl. ..... 165/173; 165/153; 165/175
(58) Field of Search ..... 165/173–176, 165/153

(56) References Cited

U.S. PATENT DOCUMENTS

| | | | | | |
|---|---|---|---|---|---|
| 3,689,972 | A | * | 9/1972 | Mosier et al. | 165/175 |
| 4,360,060 | A | * | 11/1982 | Collgon | 165/173 |
| 4,680,845 | A | | 7/1987 | Miller | |
| 4,749,033 | A | | 6/1988 | Clausen | |
| 4,759,405 | A | | 7/1988 | Metzger | |
| 4,932,469 | A | * | 6/1990 | Beatenbough | 165/153 |
| 5,052,478 | A | | 10/1991 | Nakajima et al. | |
| 5,062,476 | A | | 11/1991 | Ryan et al. | |
| 5,107,926 | A | | 4/1992 | Calleson | |
| 5,127,466 | A | * | 7/1992 | Ando | 165/173 |
| 5,152,339 | A | | 10/1992 | Calleson | |
| 5,190,101 | A | | 3/1993 | Jalilevand et al. | |
| 5,226,490 | A | | 7/1993 | Ryan et al. | |
| 5,236,042 | A | | 8/1993 | Kado | |
| 5,348,083 | A | | 9/1994 | Hosoya et al. | |
| 5,402,571 | A | | 4/1995 | Hosoya et al. | |
| 5,464,145 | A | | 11/1995 | Park et al. | |
| 5,531,268 | A | * | 7/1996 | Hoshino et al. | 165/153 |
| 5,622,220 | A | | 4/1997 | Park et al. | |
| 5,761,808 | A | | 6/1998 | Patel et al. | |
| 5,782,295 | A | | 7/1998 | Kato et al. | |
| 5,842,515 | A | | 12/1998 | Kim | |
| 5,941,303 | A | | 8/1999 | Gowan et al. | |
| 6,000,461 | A | * | 12/1999 | Ross et al. | 165/173 |
| 6,019,169 | A | | 2/2000 | Ruppel et al. | |
| 6,056,047 | A | | 5/2000 | Gowan | |
| 6,293,011 | B1 | * | 9/2001 | Hasegawa et al. | 165/173 |
| 2004/0031598 | A1 | * | 2/2004 | Shimanuki et al. | 165/164 |

FOREIGN PATENT DOCUMENTS

| | | | | | |
|---|---|---|---|---|---|
| DE | 3720483 | A1 | * | 1/1988 | 165/173 |
| GB | 2090652 | A | * | 7/1982 | 165/173 |
| JP | 55107896 | A | * | 8/1980 | 165/173 |
| JP | 61076890 | A | * | 4/1986 | 165/175 |
| JP | 04363591 | A | * | 12/1992 | 165/175 |
| JP | 05215474 | A | * | 8/1993 | 165/173 |
| JP | 7-159000 | | | 12/1993 | |

* cited by examiner

*Primary Examiner*—Leonard R. Leo
(74) *Attorney, Agent, or Firm*—Jacobson Holman PLLC

(57) ABSTRACT

An extruded D-shaped manifold machined from extruded tubing is generally D-shaped in cross-section, with the header being thicker than the tank. At least two longitudinal external ribs are formed on the header exterior, preferably positioned symmetrically relative to the longitudinal axis of the header. The external ribs provide additional strengthening of the header and act as stops to prevent the heat exchanger fins from contacting the tube/manifold joint (which can lead to leakage when the joint is brazed). The number of external ribs and their location depend on the size of the manifold and the precision required in positioning the heat exchanger tubes in the slots. The manifold can be extruded with lengthwise internal ribs extending along the interior sides of the tank to act as stops for the heat exchanger tubes.

24 Claims, 7 Drawing Sheets

EXTRUDED MANIFOLD

FIELD OF THE INVENTION

The present invention is directed to a tubular manifold for a heat exchanger, and more particularly, to a manifold that is D-shaped in cross-section and formed by extrusion.

BACKGROUND OF THE INVENTION

Currently, single piece manifolds are made from roll-formed, welded tubing, and are available in gauges from 0.040 inch (0.1016 cm) to 0.065 inch (0.1651 cm) and diameters up to 1.50 inch (3.81 cm). Although parallel flow technology has been widely adopted in the automotive industry, it has not been adopted in the HVAC industry. From a manifold standpoint, two basic problems have arisen in applying parallel flow technology to the HVAC industry. First, the price per pound for the manifolds is too high (averaging about $11.00 per pound in 2000) and second, the burst pressure is too low for the newer refrigerants (pressures in the HVAC industry being much higher than in the automotive industry).

In addition, the current method of manufacturing manifolds, using piercing dies, makes it difficult to create samples for customers. The tooling for a manifold is designed around the individual customer's centerline spacing, which involves both the tube and fin height and width. The tooling is very expensive and usually requires long lead times for design, development, and fabrication. Currently, tooling only exists for a limited number of sizes and centerlines, and these available sizes and centerlines may not meet a particular customer's needs. An increase in the existing gauge of the tubing also requires a significant tooling charge for forming rolls on tube mills. Tubing suppliers generally are not willing to bear this expense unless the customer can guarantee a large order or pay the up-front tooling cost.

Despite these disadvantages, roll-formed, welded tubing has several advantages. Once the correct gauge is selected, the tube mills can produce the tubing at a high rate of speed, the product is very consistent, and braze cladding is already a constituent of the material being welded.

Thus, there is a need for a tubular manifold that has a higher burst pressure and is less expensive than roll-formed, welded manifolds, but that can be manufactured quickly, and with the consistency of roll-formed, welded manifolds.

It is to the solution of these and other problems that the present invention is directed.

BRIEF SUMMARY OF THE INVENTION

It is therefore an object of the present invention to provide a tubular manifold that has a burst pressure high enough for the newer refrigerants.

It is another object of the present invention to provide a tubular manifold that is economical to manufacture.

It is still another object of the present invention to provide a tubular manifold in which the size, centerline, and gauge can all easily and inexpensively be customized.

It is still another object of the present invention to provide a tubular manifold that can be manufactured at a high rate of speed while maintaining consistency of the product.

These and other objects of the present invention are achieved by the provision of a one-piece, seamless, D-shaped manifold that is machined from extruded tubing rather than from roll-formed, welded tubing. The extruded tubing has a substantially flat part and a concavely curved part, so as to be substantially D-shaped in cross-section. The substantially flat part, which forms the manifold header, is thicker than the concavely curved part, which forms the manifold tank, in order to provide improved burst strength. At least two longitudinal ribs (hereafter referred to as external ribs) are formed on the header exterior, preferably positioned symmetrically relative to the longitudinal center line of the header. The external ribs provide additional strengthening of the header and act as stops to prevent the heat exchanger fins from contacting the tube/manifold joint and the substantially flat outer surface of the header (which can lead to leakage when the joint is brazed). The number of external ribs and their location will depend on the size of the manifold and the precision required in positioning the heat exchanger tubes in the slots.

Slots for insertion of heat exchanger tubes through the header are formed by machining, during which the adjoining edges of the external ribs are chamfered. Alternatively, the slots are roughed out by sawing, then finalized by milling, and during milling, the adjoining edges of the external ribs are chamfered. The chamfering of the external rib edges has the added advantage of providing a guide surface for the heat exchanger tubes as they are inserted into the tube slots.

Cladding is applied on the outside of the finished manifold. The substantially flat exterior surface of the header provides a better surface for applying the cladding than a tube having a totally circular cross-section. During brazing, the cladding melts to seal the tube/manifold joints.

The manifold can be extruded with lengthwise ribs (hereafter referred to as internal ribs) extending along the interior sides of the tank to act as stops for the heat exchanger tubes.

Baffles can be placed between selected tube slots by machining a cut into the same surface as the tube slots, that is, into the header. The cut can extend into the tank. The baffles are driven into place with a press. Baffles can also be placed in cuts adjacent the ends of the manifold to serve as end caps.

DETAILED DESCRIPTION OF THE INVENTION

Figure 1:
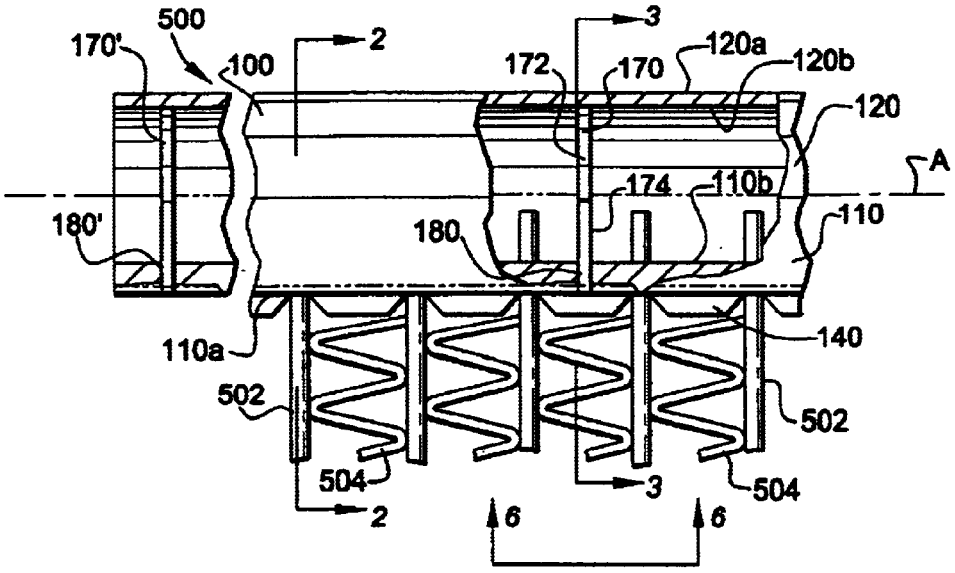
FIG. 1 is a side elevational view, partially in cross-section, showing a portion of a heat exchanger incorporating a first embodiment of a manifold in accordance with the invention.
Figure 2:
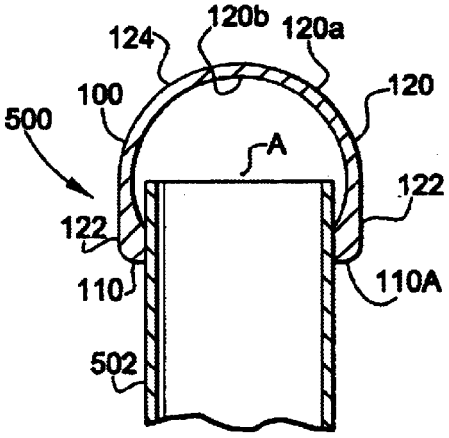
FIG. 2 is a cross-sectional view taken along line 2—2 of FIG. 1.

Referring now to FIGS. 1–3, 6, and 7, there is shown a first embodiment of a tubular, or one-piece, manifold 100 in accordance with the present invention. The manifold 100 is of the type intended for use in a heat exchanger 500 comprising a pair of opposed manifolds 100, heat exchanger tubes 502 extending between the opposed manifolds 100, and heat exchanger fins 504 positioned between the heat exchanger tubes 502, as shown in U.S. Pat. No. 5,464,145 to Park et al., incorporated herein by reference. The heat exchanger tubes 502 can have one or more internal partitions defining multiple passages (not shown), as disclosed in U.S. Pat. No. 5,174,373 to Shinmura, which is incorporated herein by reference.

Figure 3:
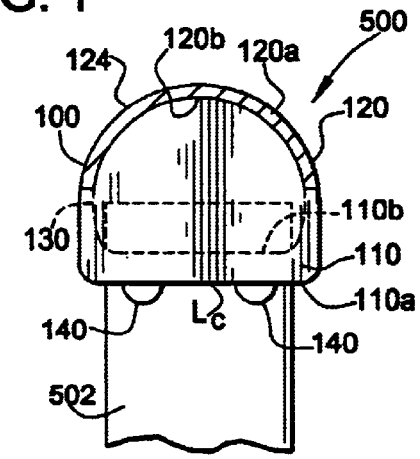
FIG. 3 is a cross-sectional view taken along line 3—3 of FIG. 1.
Figure 7:
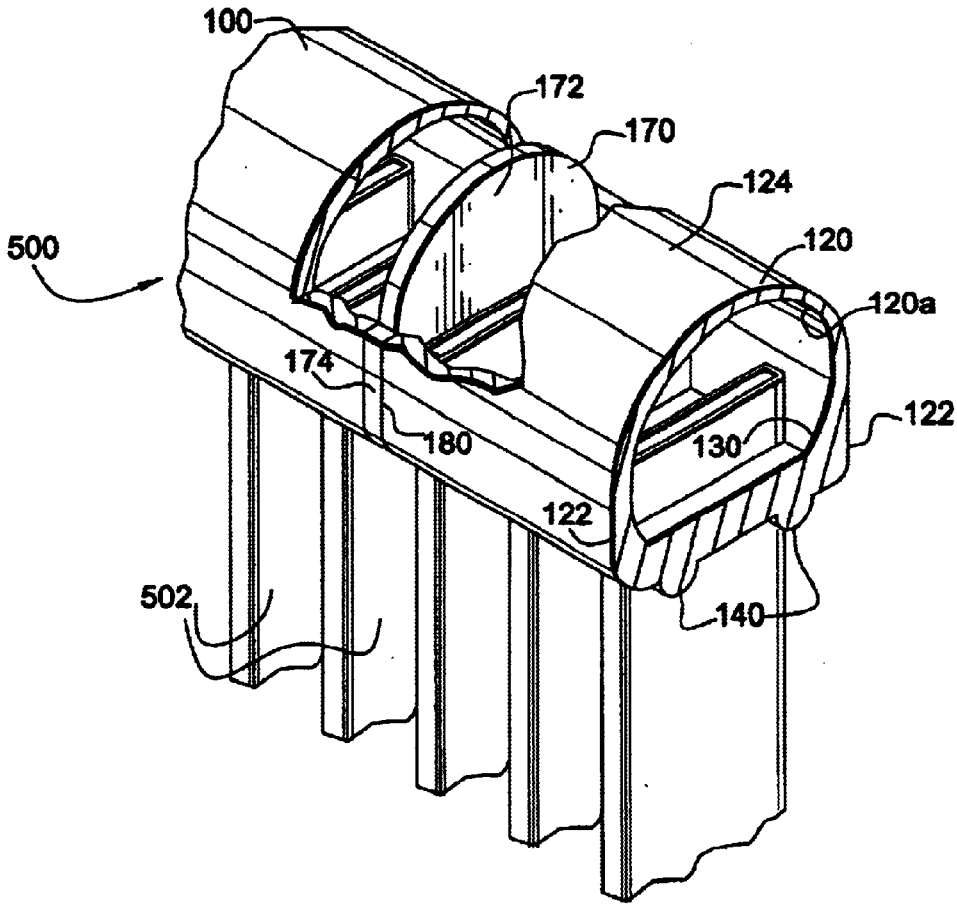
FIG. 7 is a partial perspective view of the heat exchange of FIG. 1.
Figure 8:
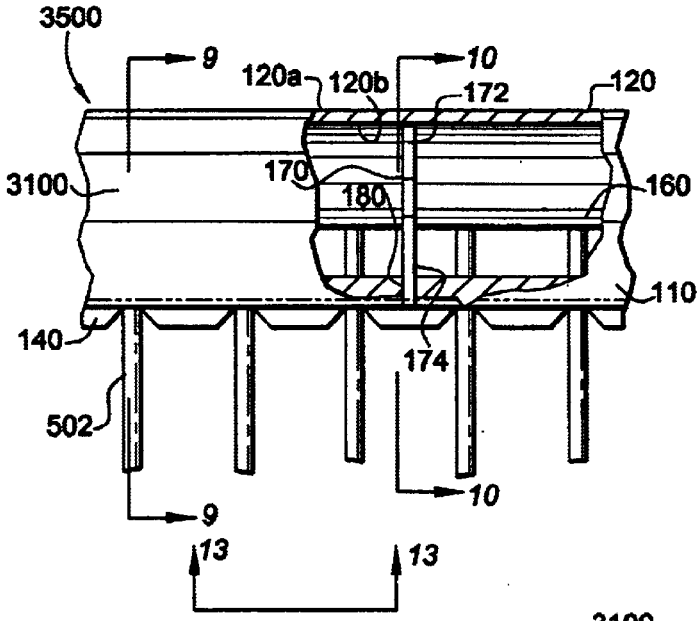
FIG. 8 is a side elevational view, partially in cross-section, showing a portion of a heat exchanger incorporating a fourth embodiment of a manifold in accordance with the invention.
Figure 9:
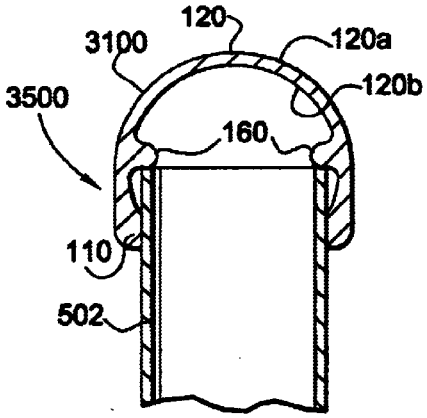
FIG. 9 is a cross-sectional view taken along line 9—9 of FIG. 8.
Figure 10:
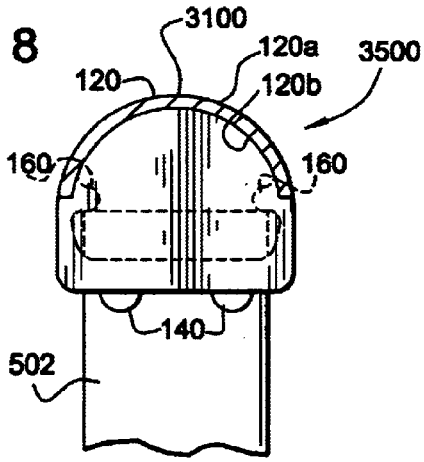
FIG. 10 is a cross-sectional view taken along line 10—10 of FIG. 8.

The manifold 100 is made from extruded tubing having a substantially flat part and a concavely curved part, so as to be substantially D-shaped in cross-section. As best shown in FIGS. 3 and 7, the substantially flat part, which forms the manifold header 110, is thicker than the concavely curved part, which forms the manifold tank 120, in order to provide improved burst strength.

With reference to the embodiment shown in FIGS. 1–3, 6, and 7, the tank 120 has opposed sides 122, which terminate at the header 110, and a substantially semicylindrical center portion 124 that extends between the sides 122, the longitudinal axis A of the manifold 100 corresponding to the generatrix of the semicylindrical center portion 124. The exterior and interior surfaces 120*a* and 120*b* of the tank 120 at the center portion 124 are substantially concentric. However, as best shown in FIGS. 3 and 7, the radius of curvature of the tank interior surface 120*b* decreases at the junction 130 of the sides 122 with the interior surface 110*b* of the header 110, while the tank sides 122 on the exterior surface 120*b* are substantially planar and parallel to each other.

Because extrusion dies are relatively inexpensive, the tubing for the manifold 100 can be produced in any desired wall thickness at relatively low expense. Also, because the manifold 100 is made from extruded tubing, it is not only one-piece, but also seamless and jointless, and thus less likely to leak.

Figure 4:
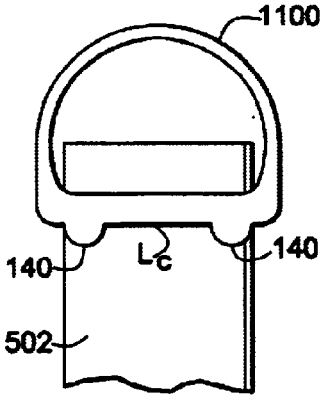
FIG. 4 is an end elevational view of a heat exchanger incorporating a second embodiment of a manifold in accordance with the present invention.

The tubing is extruded with at least two longitudinal external ribs formed on the exterior surface of the substantially flat part, preferably positioned symmetrically relative to the longitudinal center line of the substantially flat part. Thus, when the extruded tubing is cut to the prescribed length for the manifold 100, the exterior surface 110*a* of the header 110 includes a corresponding number of external ribs 140 positioned symmetrically relative to the longitudinal center line $L_c$ of the header 110. In the embodiment shown in FIGS. 1–3, 6, and 7, the header 110 includes two longitudinal external ribs 140 (longitudinal or lengthwise are used herein to refer to a dimension parallel to the longitudinal axis A of the manifold 100), positioned symmetrically to either side of the longitudinal center line $L_c$ of the header 110. The external ribs 140 provide additional strengthening of the header 110 and act as stops to prevent the heat exchanger fins 504 from contacting the heat exchanger tube/manifold joint and the substantially flat outer surface of the header 110 (which can lead to leakage when the joint is brazed). As shown in FIG. 4 (illustrating another embodiment of a manifold 1100), the distance of the longitudinal external ribs 140 from either side of the longitudinal center line $L_c$ of the tank 120 can be varied depending upon the accuracy required in guiding the ends of the heat exchanger tubes 502 into the tube slots 150 and how much of the perimeter of the ends of the heat exchanger tubes 502 it is desired to encapsulate between the chamfers 152 of the ribs 140.

Figure 5:
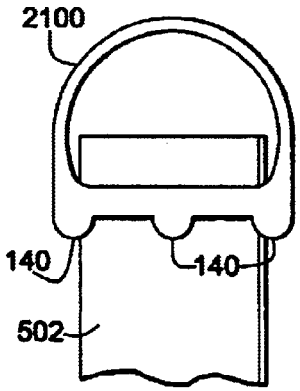
FIG. 5 is an end elevational view of a heat exchanger incorporating a third embodiment of a manifold in accordance with the present invention.

Although in the embodiments shown in FIGS. 1–3, 6, and 7 and in FIG. 4, the manifold 100 has two longitudinal external ribs 140, it can be formed with more than two external ribs 140. The number of external ribs 140 and their location will depend on the size of the manifold 100 and the precision required in positioning the heat exchanger tubes 502 in the slots. FIG. 5 shows an embodiment of a manifold 2100 in which there are three external ribs 140. Generally, if there are an even number of external ribs 140, they will be disposed symmetrically on either side of the center line $L_c$; and if there are an odd number of external ribs 140, the center external rib 140 will be disposed on the center line $L_c$ and the remaining external ribs 140 will be disposed symmetrically on either side of the center line $L_c$.

Figure 6:
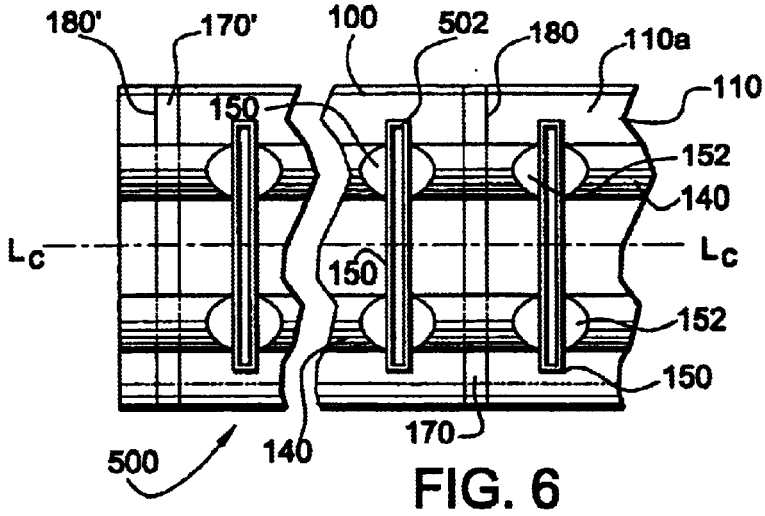
FIG. 6 is a partial bottom plan view taken along line 6—6 of FIG. 1.

With reference to FIG. 6, in order to allow heat exchanger tubes 502 to be inserted through the header 110, tube slots 150 are formed in the header 110 perpendicular to the center line $L_c$. The tube slots 150 can be formed by machining. The milling cutter used for the machining operation is shaped to cut a chamfer 152 in the adjoining edges of the external ribs 140 at the same time the tube slots 150 are machined.

Alternatively, the tube slots 150 can be roughed out in the header 110 by sawing and then finalized by milling. This technique makes it possible to obtain any centerline spacing and tube slot size at a reasonable cost and a short lead-time. Following the sawing operation, the rough edges of the tube slots 150 are finished by milling. During this operation, the adjoining edges of the external ribs 140 are also chamfered.

Chamfering the external rib edges has the added advantage of providing a guide surface for the heat exchanger tubes 502 as they are inserted into the tube slots 150. Thus, increasing the number of external ribs 140 provides more precision in positioning the heat exchanger tubes 502 in the tube slots 150. Chamfering the adjoining external rib edges during slotting also minimizes the amount of material that must be removed, in contrast with chamfering the substantially flat exterior surface 110*a* per se; and does not otherwise effect the burst strength of the substantially flat exterior surface 110*a* as it would if chamfering were added to the substantially flat exterior surface 110*a*.

Figure 11:
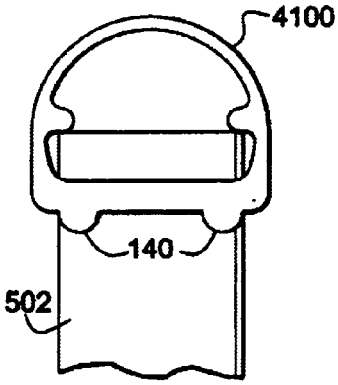
FIG. 11 is an end elevational view of a heat exchanger incorporating a fifth embodiment of a manifold in accordance with the present invention.
Figure 12:
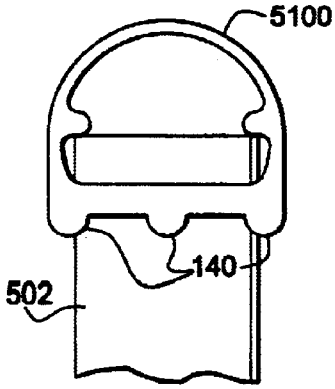
FIG. 12 is an end elevational view of a heat exchanger incorporating a sixth embodiment of a manifold in accordance with the present invention.
Figure 13:
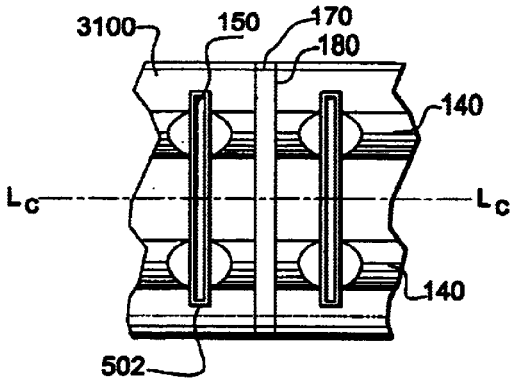
FIG. 13 is a partial bottom plan view taken along line 13—13 of FIG. 8.
Figure 14:
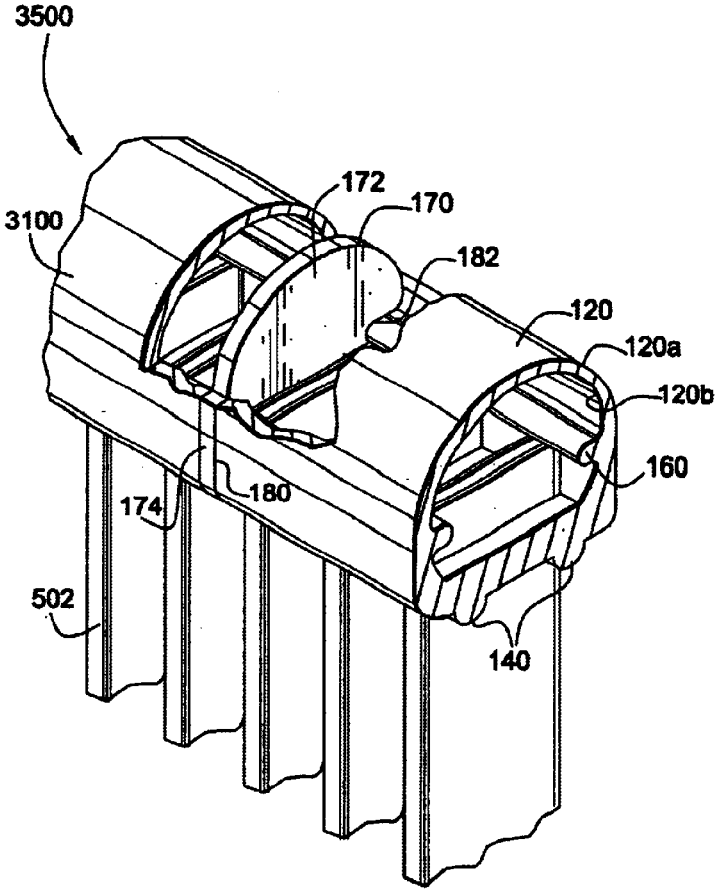
FIG. 14 is a partial perspective view of the heat exchanger of FIG. 8.

The tubing can be extruded with a single lengthwise internal rib extending along the interior surface of the concavely curved part, spaced apart from the interior surface of the substantially flat part; or with two opposed lengthwise internal ribs extending along the interior surface of the concavely curved part. FIGS. 8–10, 13, and 14 show a heat exchanger 3500 incorporating a manifold 3100 made from such tubing. In the finished manifold 3100, the singe internal rib 160 or pair of internal ribs 160 extend lengthwise along the interior surface 120*b* of the tank 120 to act as stops for the heat exchanger tubes 502. As shown in FIGS. 11 and 12, the spacing and number of the external ribs 140 can be varied in a manifold 4100 or 5100 having a single internal rib 160 or a pair of internal ribs 160, in the same manner and for the same reasons as in a manifold without the internal ribs 160.

It is well known that in order to adjust the number of passes in a parallel flow heat exchanger, one or more baffles can be placed in one or both of the manifolds. In the manifolds 100 (FIGS. 1–3, 6, and 7) and 3100 (FIGS. 8–10, 13, and 14) in accordance with the present invention, cuts 180 are machined into the same surface as the tube slots 150 (that is, into the header 110) at the locations between the tube slots 150 where it is desired to place the baffles 170 (see FIGS. 1, 6, 7, 8, 13, and 14). These cuts 180 are perpendicular to the center line $L_c$, and preferably extend into the tank 120 at least part way up the tank sides 122. In the case where the manifold 3100 has at least one lengthwise internal rib 160, a corresponding cut 182 is simultaneously also machined through the at least one internal rib 160. The baffles 170 are inserted into the manifold 100 through the cuts 180 between the selected tube slots 150 and driven into place with a press. Cuts can also be machined into the header 110 adjacent the ends, perpendicular to the center line $L_c$, and baffles 170 can be inserted into the end cuts 180' and driven into place to serve as end caps 170'. The end caps 170' serve a structural purpose, in that they must provide adequate burst strength against internal pressures in the manifold 100, while the baffles 170 are only for partitioning and are subject to a net pressure of near zero. The end caps 170' therefore are usually thicker than the baffles 170, and in any event are of sufficient thickness to withstand the high internal pressure in the manifold 110.

The baffles 170 and end caps 170' have a thickness slightly less than that of their corresponding cuts 180 and 180' for ease of insertion. Any gaps between the baffles 170 and end caps 170' and their corresponding cuts 180 and 180' are sealed during brazing.

Figure 15:
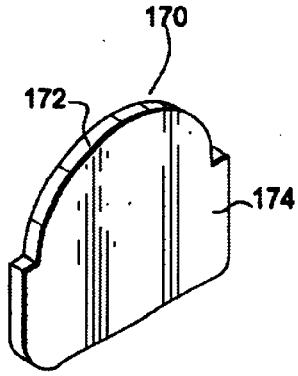
FIG. 15 is a perspective view of a baffle for use with any of the manifolds in accordance with the present invention. an end elevational view of a heat exchanger incorporating a third embodiment of a manifold in accordance with the present invention.

As shown in FIG. 15, the baffles each have a first portion 172 that substantially conforms in shape to the uncut interior surface of the manifold 100 and a second portion 174 that substantially conforms in shape to the exterior surface of the manifold 100 at the cut. Thus, the cross-sectional contours of the manifold 100 are maintained when the baffles 170 are driven into place. The configuration of the end caps 170' is identical to that of the baffles 170, except that, as discussed above, the end caps 170' may be thicker. The baffles 170 and end caps 170' braze in as solid pieces, and so do not adversely affect the integrity of the finished manifold 100.

Clad material cannot be extruded. Accordingly, cladding is applied on the outside of the finished manifold 100, 1100, 2100, 3100, 4100, and 5100, and generally only to the exterior surface 110*a* of the header 110. Also, in general, the cladding is applied after all parts are assembled as the last operation prior to brazing. Alternatively, it can be applied before the baffles (if any) and end caps 170 are inserted.

Figure 16:
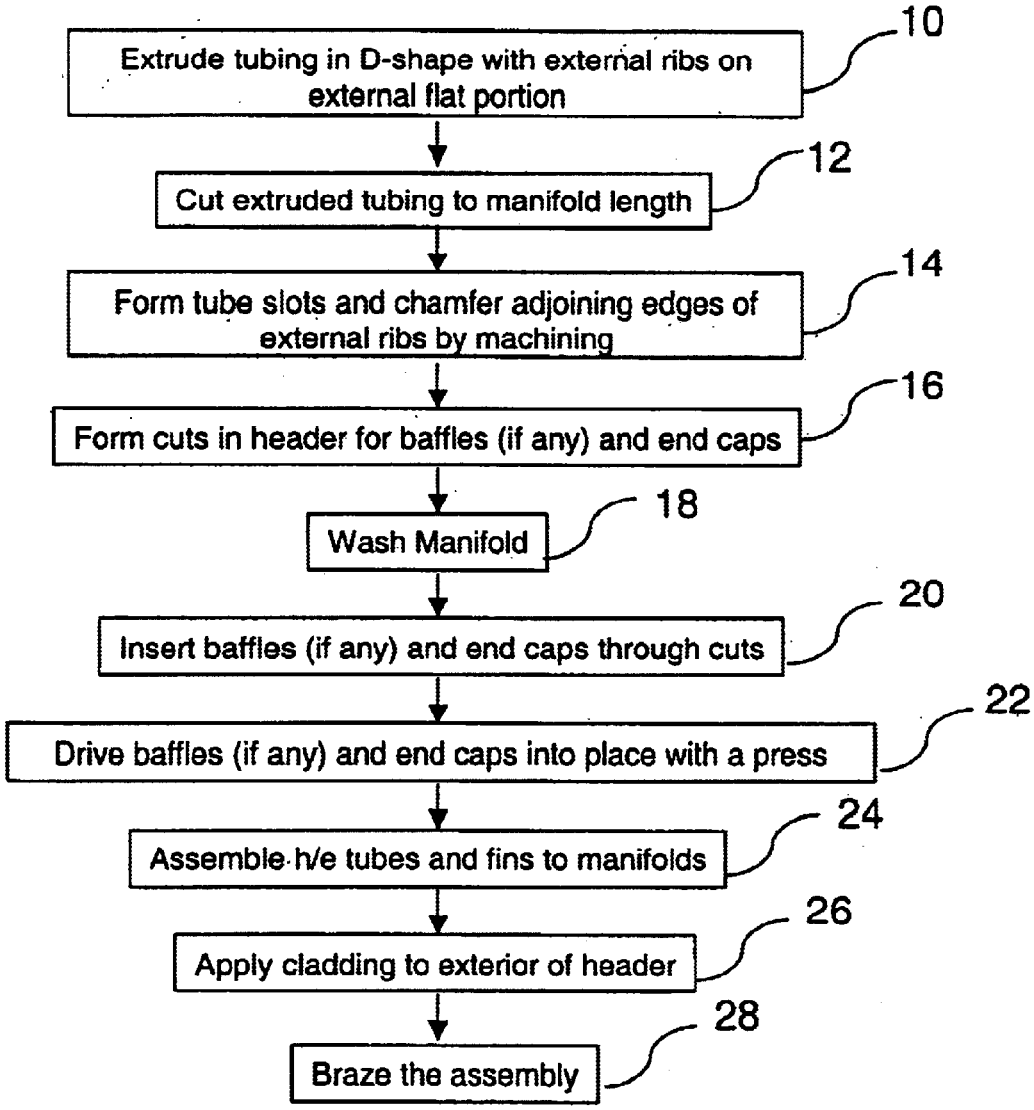
FIG. 16 is a flow diagram setting forth the steps in a first embodiment of a method of manufacturing of a heat exchanger incorporating the manifold of FIG. 1.

If the cladding is applied after all parts are assembled, as shown in FIG. 16, then preferably, the cladding is a braze paste such as that described in U.S. Pat. No. 5,251,374 (which is incorporated herein by reference in its entirety), which is commercially available from S. A. Day Mfg. Co. under the Dayclad trademark; or a liquid coating, such as the fluoride-based flux that is commercially available from Alcan Aluminum Ltd. under the Nocolok Sil Flux trademarks.

Figure 18:
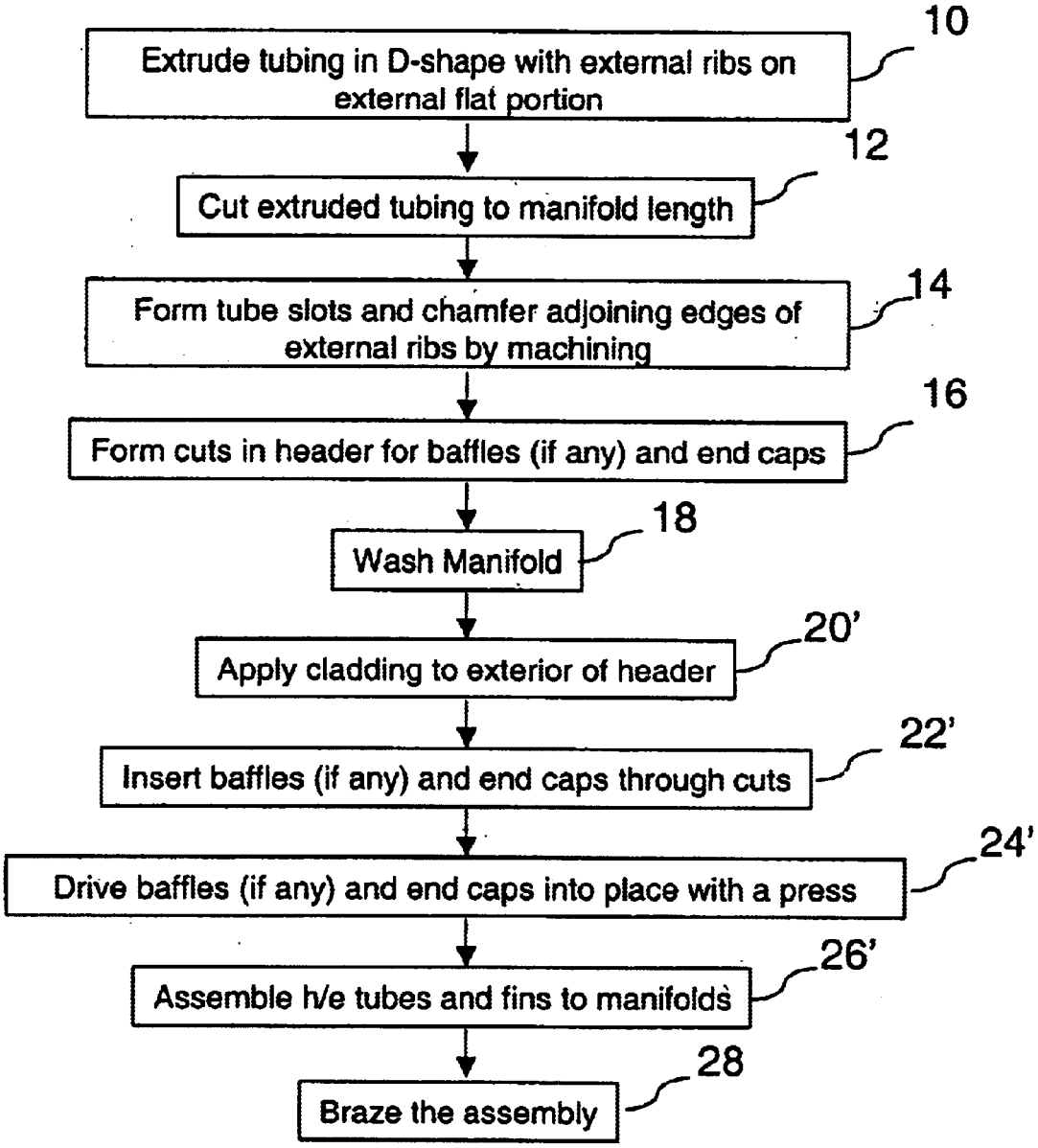
FIG. 18 is a flow diagram setting forth a second alternative embodiment of the method of manufacturing the heat exchanger.

If the cladding is applied before the baffles 170 (if any) and end caps 170' are inserted, as shown in FIG. 18, then preferably, the cladding is a self-adhering coating. An example of a self-adhering coating that can be used with the manifold 100 is the cladding material sold by Mitsubishi Aluminum under the Brazeliner trademark, and which is an alloy of aluminum, silicon, and zinc or aluminum and silicon, and which is described in U.S. Pat. Nos. 5,656,332; 5,820,698; 5,907,761; and 6,113,667, all of which are incorporated herein by reference in their entireties. The self-adhering coating can be applied by spraying, for example with a spray gun. When the coating is heated, a binder in the alloy causes it to adhere to the surface of the manifold 100. The relatively flat exterior surface 110*a* of the header 110 provides a better surface for applying the cladding than the curved surface of a manifold having a substantially circular cross-section. The external ribs 140 help to contain the self-adhering coating when it is applied. During brazing, the cladding melts to seal the heat exchanger tube/manifold joints.

Figure 17:
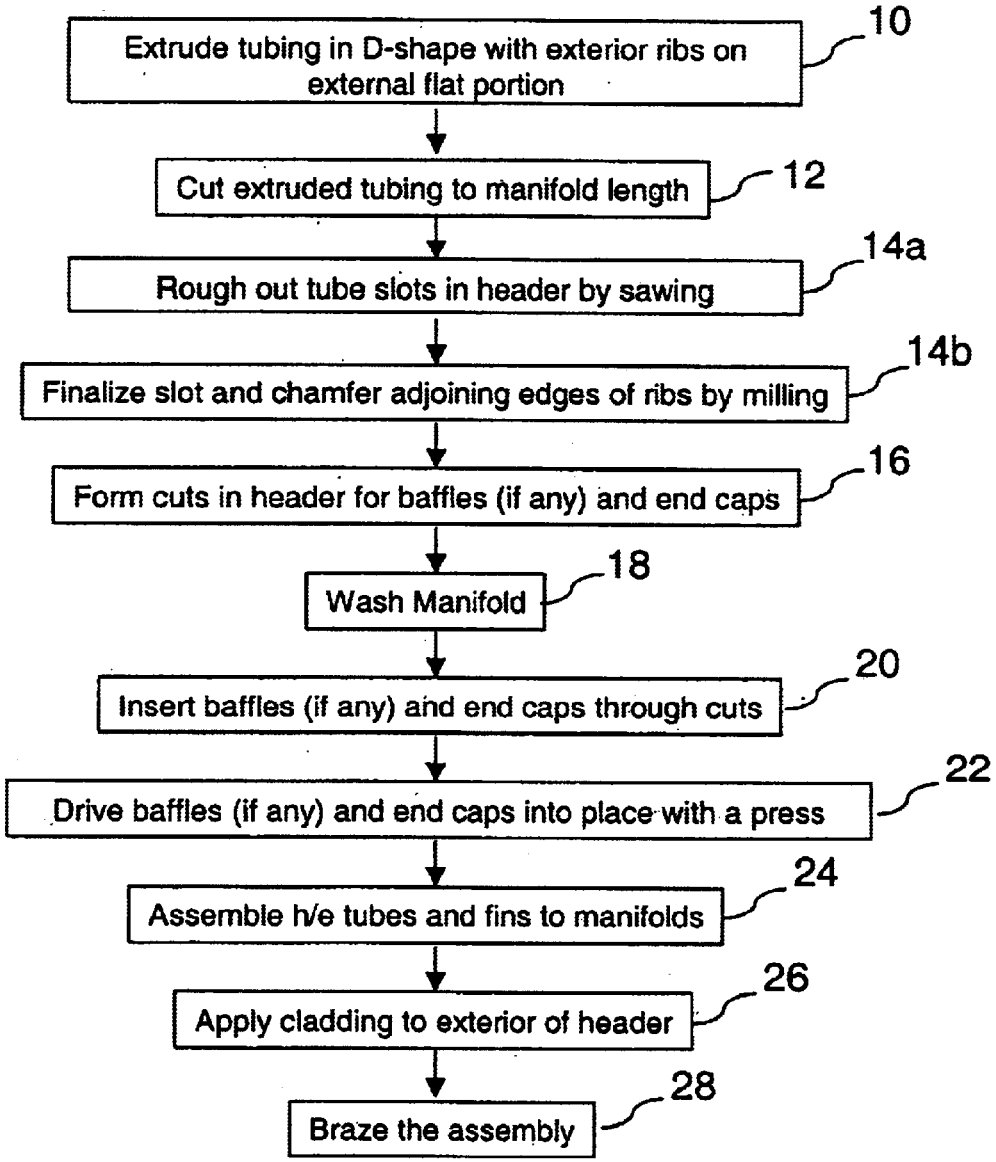
FIG. 17 is a flow diagram setting forth a first alternative embodiment of the method of manufacturing the heat exchanger.

Referring now to FIG. 16, there is shown a flow diagram setting forth the steps in the manufacture of a heat exchanger incorporating the manifold 100, 1100, 2100, 3100, 4100, or 5100 in accordance with the present invention. In the first step 10, tubing is extruded with a D-shaped cross-section and with external ribs on the exterior substantially flat portion. In the second step 12, the extruded tubing is cut to manifold length. In the third step 14, tube slots 150 are formed by machining using a milling cutter shaped to concurrently cut a chamfer 152 at the adjoining edges of the external ribs 140. Alternatively, as shown in FIG. 17, in a first part 14*a* of the third step, tube slots 150 are roughed out in the manifold header 110 by sawing or machining with cutting blades; and in a second part 14*b* of the third step, the edges of the tube slots 150 are finalized and the adjoining edges of the external ribs 140 are chamfered by milling with a milling head. In the fourth step 16, cuts are machined in the header 110 for baffles 170 (if any) and end caps. In the fifth step 18, the manifold 100 is washed. In the sixth step 20, the baffles 170 (if any) and the end caps 170' are inserted through the cuts 180 and 180', respectively. In the seventh step 22, the baffles 170 (if any) and the end caps 170' are driven into place with a press. In the eighth step 24, the heat exchanger tubes 502 and fins 504 are assembled to a pair of opposed manifolds 100, 1100, 2100, 3100, 4100, or 5100. In the ninth step 26, the cladding material is applied to the exterior of each manifold 100. In the tenth (final) step 28, the assembled heat exchanger 500 is brazed.

Alternatively, as shown in FIG. 18, the cladding material can be applied as the sixth step 20', following the step of washing the manifold 100. In that case, the steps of inserting the baffles 170 (if any) and end caps, driving the baffles 170 (if any) and end caps into place, and assembling the heat exchanger tubes 502 and fins 504 to a pair of manifolds 100 become the seventh, eighth, and ninth steps 22', 24', and 26', respectively.

Modifications and variations of the above-described embodiments of the present invention are possible, as appreciated by those skilled in the art in light of the above teachings. It is therefore to be understood that, within the scope of the appended claims and their equivalents, the invention may be practiced otherwise than as specifically described.

We claim:

1. A manifold for a heat exchanger, the manifold being formed of a section of one-piece, seamless, and jointless tubing; the manifold having a substantially flat, external part and a concavely curved external part so as to have a substantially D-shaped cross section, with the substantially flat part forming an external manifold header and the concavely curved part forming an external manifold tank, the header having:

a lengthwise center line, a plurality of tube slots formed therein perpendicular to the center line for the insertion of heat exchanger tubes and at least two longitudinal external ribs formed on the exterior surface thereof, wherein the edges of the external ribs adjoining the tube slots are chamfered.

2. The manifold of claim 1, wherein the external ribs are positioned symmetrically relative to the center line.

3. The manifold of claim 1, further having a cladding material applied to at least a portion of the exterior surface thereof.

4. The manifold of claim 3, wherein the cladding material is applied to the exterior of the header.

5. The manifold of claim 3, wherein the cladding material comprises a self-adhering coating.

6. The manifold of claim 5, wherein the self-adhering coating is an alloy comprising aluminum and silicon.

7. The manifold of claim 6, wherein the alloy further includes zinc.

8. The manifold of claim 1, wherein the manifold header is thicker than the tank.

9. The manifold of claim 1, further having at least one lengthwise internal rib extending along the interior surface of the tank spaced apart from the interior surface of the header to act as stops for the heat exchanger tubes.

10. The manifold of claim 1, wherein the manifold further has cuts formed in the header at either end perpendicular to the center line and baffles inserted into the manifold interior through the cuts to serve as end caps.

11. The manifold of claim 10, wherein each of the baffles has a first portion that substantially conforms in shape to the uncut interior surface of the manifold and a second portion that substantially conforms in shape to the exterior surface of the manifold at the cut.

12. The manifold of 10, wherein the manifold further has at least one cut formed in the header between a pair of adjacent tube slots perpendicular to the center line of the header and a corresponding baffle inserted therethrough into the manifold interior to alter the flow path through the manifold, wherein each of the baffles has a first portion that substantially conforms in shape to the uncut interior surface of the manifold and a second portion that substantially conforms in shape to the exterior surface of the manifold at the cut.

13. The manifold of claim 1, wherein the tube slots extend across the at least two longitudinal external ribs.

14. A manifold for use in a heat exchanger having a pair of opposed manifolds and heat exchanger tubes extending between the manifolds and heat exchanger fins interposed between the heat exchanger tubes, the manifold being formed of a section of one-piece, seamless, and jointless tubing, the manifold having a substantially flat part and a concavely curved part so as to have a substantially D-shaped cross section, with the substantially flat part forming a manifold header and the concavely curved part forming a manifold tank, the header having a lengthwise center line and including:

a plurality of tube slots formed therein perpendicular to the center line for the insertion of heat exchanger tubes and means for guiding the heat exchanger tubes into the tube slots and preventing the heat exchanger fins from contacting the joints between the manifold and the heat exchanger tubes and the substantially flat outer surface of the header.

15. The manifold of claim 14, wherein the manifold further has cuts formed in the header at either end perpendicular to the center line and baffles inserted into the manifold interior through the cuts to serve as end caps.

16. The manifold of claim 15, further having at least one lengthwise internal rib extending along the interior surface of the tank spaced apart from the interior surface of the header to act as stops for the heat exchanger tubes.

17. The manifold of claim 15, wherein each of the baffles has a first portion that substantially conforms in shape to the uncut interior surface of the manifold and a second portion that substantially conforms in shape to the exterior surface of the manifold at the cut.

18. The manifold of 15, wherein the manifold further has at least one cut formed in the header between a pair of adjacent tube slots perpendicular to the center line and a corresponding baffle inserted therethrough into the manifold interior to alter the flow path through the manifold, wherein each of the baffles has a first portion that substantially conforms in shape to the uncut interior surface of the manifold and a second portion that substantially conforms in shape to the exterior surface of the manifold at the cut.

19. The manifold of claim 14, further having a cladding material applied to at least a portion of the exterior surface thereof.

20. The manifold of claim 19, wherein the cladding material is applied to the exterior of the header.

21. The manifold of claim 19, wherein the cladding material comprises a self-adhering coating.

22. The manifold of claim 21, wherein the self-adhering coating is an alloy comprising aluminum and silicon.

23. The manifold of claim 22, wherein the alloy further includes zinc.

24. The manifold of claim 14, wherein the manifold header is thicker than the tank.

* * * * *